US006557215B1

(12) United States Patent
Graf

(10) Patent No.: US 6,557,215 B1
(45) Date of Patent: May 6, 2003

(54) DEVICE AND METHOD FOR CLEANING ALL-STEEL SAWTOOTH ARRANGEMENTS OF A SWIFT

(75) Inventor: Ralph A. Graf, Freienbach (CH)

(73) Assignee: Graf + Cie AG, Rapperswil (CH)

( * ) Notice: Subject to any disclaimer, the term of this patent is extended or adjusted under 35 U.S.C. 154(b) by 238 days.

(21) Appl. No.: 09/611,461

(22) Filed: Jul. 7, 2000

(30) Foreign Application Priority Data

Jul. 13, 1999 (DE) ..... 199 32 679

(51) Int. Cl.[7] ..... D01G 15/76
(52) U.S. Cl. ..... 19/108; 19/218
(58) Field of Search ..... 134/6, 42; 19/108, 19/218, 107

(56) References Cited

U.S. PATENT DOCUMENTS 1,743,069 A 1/1930 Walsh ..... 19/108
2,536,589 A 1/1951 Blank ..... 19/108
5,054,166 A * 10/1991 Demuth et al. ..... 19/108
5,455,990 A * 10/1995 Genevray ..... 19/108
6,230,368 B1 * 5/2001 Patelli et al. ..... 19/106 R

* cited by examiner

*Primary Examiner*—Randy Gulakowski
*Assistant Examiner*—Saeed Chaudhry
(74) *Attorney, Agent, or Firm*—Friedrich Kueffner

(57) ABSTRACT

A cleaning device for cleaning an all-steel sawtooth arrangement of a swift of a card has adjacently arranged sawtooth wire sections, wherein between two adjacent sawtooth wire sections a groove of the all-steel sawtooth arrangement is formed, respectively. The grooves extend from the tooth tips of the sawtooth wire sections to the groove bottom. The cleaning device has one or more cleaning elements for removing foreign particles from the grooves, wherein the cleaning element comprises a cleaning portion that is placed against the groove bottom of a groove and follows the groove when the all-steel sawtooth arrangement is moved in rotation to thereby remove foreign particles from the groove bottom.

25 Claims, 3 Drawing Sheets

DEVICE AND METHOD FOR CLEANING ALL-STEEL SAWTOOTH ARRANGEMENTS OF A SWIFT

BACKGROUND OF THE INVENTION

1. Field of the Invention

The invention relates to a device for cleaning an all-steel sawtooth arrangement of a swift of a card or carding machine with a number of adjacently positioned sawtooth wire sections, wherein between the threads or windings of neighboring sawtooth wire sections a groove of the all-steel sawtooth arrangement is formed extending from the tooth tips of the sawtooth wire sections to the groove bottom, comprising at least one cleaning element for removing foreign particles from the grooves of the all-steel sawtooth arrangement. The invention also relates to a cleaning method that can be performed with such a device.

2. Description of the Related Art

Devices and methods of the aforementioned kind are required, for example, in connection with the operation of a card and, in particular, when operating a carding machine. During the operation of a card, short fibers and neps will collect in the area of a swift arrangement, formed by a sawtooth wire extending in a coil shape about a corresponding support, in the grooves of the all-steel sawtooth arrangement formed between the individual windings of the all-steel sawtooth arrangement. When operating carding machines for processing or producing carded yarns, combed yarns, synthetic fibers, cotton wadding, fleece material etc., foreign particles such as finishes, melted synthetic fiber packets as well as straw, wood, and burs will collect in the area of the corresponding swift or drum arrangements in Morell-type rollers when processing wool. These foreign particles must be removed from the grooves of the all-steel sawtooth arrangement for ensuring a satisfactory work result. For this purpose, it is conventional to employ cleaning brushes which are arranged outside of the actual working area of the swift or drum and rotate about a rotational axis which extends parallel to the rotational axis of the swift. During the cleaning process the cleaning brush bristles sweep through the all-steel sawtooth arrangement and remove foreign particles from the grooves of the all-steel sawtooth arrangement. After leaving the grooves of the all-steel sawtooth arrangements, the foreign particles are then removed conventionally by a suction device or the like from the cleaning brushes so that the cleaning brush bristles will not introduce new foreign particles during the subsequent sweep through the all-steel sawtooth arrangement.

Even though with these known cleaning devices, at least during processing of cotton fibers, satisfactory cleaning results can be obtained, it was found that the cleaning process that can be performed therewith results in additional wear of the all-steel sawtooth arrangement, which is already subjected to great wear due to the fiber processing, this additional wear resulting in a corresponding reduction of the service life of the all-steel sawtooth arrangement. Moreover, when using the known cleaning devices during the operation of a carding machine, only an incomplete cleaning of the corresponding swift or drum arrangement will be obtained. For eliminating the first mentioned deficiency, DE 195 32 592 C1 has already proposed cleaning devices that are useable for the cleaning of circular combs and make a contactless and accordingly wear-reduced cleaning process possible. When using the cleaning devices described in the aforementioned document for cleaning swift arrangements, however, only unsatisfactory cleaning results are obtained, in general. This is true especially for use of the known cleaning devices for cleaning high performance carding machines with which synthetic fibers are processed. In these machines a manual cleaning step must be performed, even when using the known cleaning brushes, in order to achieve a complete cleaning.

SUMMARY OF THE INVENTION

It is an object of the present invention to provide a cleaning device of the aforementioned kind with which, while eliminating excessive wear of the all-steel sawtooth arrangement, a satisfactory cleaning can be achieved, even for operating carding machines that are used for processing synthetic fibers, and to provide also a cleaning method to be performed therewith.

In accordance with the present invention, this is achieved with respect to the device in that the cleaning element has a cleaning portion, preferably in the form of a cleaning blade, that can be placed against the groove bottom.

This invention is based on the finding that during the operation of a device for processing textile fibers foreign particles that collect in the area of the all-steel sawtooth arrangement are deposited only to a small degree in the area of the tooth tips of the sawtooth wires and are collected primarily in the area of the groove bottom of the grooves of the all-steel sawtooth arrangement that are formed between the individual sawtooth wire sections of an all-steel sawtooth arrangement. This holds true especially when processing synthetic fibers wherein the foreign particles are substantially comprised of melted products of the synthetic fibers which are produced from the synthetic fibers under the effect of the high temperatures resulting from operation of the high performance carding machines.

These foreign particles can be removed reliably and completely from the all-steel sawtooth arrangement by means of the cleaning portion of the cleaning device according to the invention resting against the groove bottom and being preferably in the form of a cleaning blade comprised of spring steel, without the sawteeth or sawtooth tips used for the actual fiber processing being loaded by the cleaning portion by an appreciable force. Accordingly, a satisfactory cleaning can be achieved with the cleaning device according to the invention, while preventing an appreciable wear of the all-steel sawtooth arrangement, even when melted products resulting during processing of synthetic fibers adhere to the all-steel sawtooth arrangement in the area of the groove bottom. These effects can be achieved in the cleaning of those all-steel sawtooth arrangements in which the groove bottom is formed by the foot of a sawtooth wire that is spirally applied as well as in the cleaning of those all-steel sawtooth arrangements in which the sawtooth wire is applied to a support provided with grooves so that the groove bottom is at least partially formed by the support surface.

In this context, the cleaning device according to the invention can be used not only as an alternative in the cleaning of the swift of a carding machine but also in addition to the known cleaning brushes. A gentle treatment of the all-steel sawtooth arrangement can be achieved in this context in that during the additional use of the device according to the invention cleaning brushes with softer cleaning brush bristles are employed.

In order to achieve an especially good cleaning action, it was found to be expedient to couple the cleaning element with a tensioning device forcing the cleaning portion in the direction toward the groove bottom because a reliable contact of the cleaning portion on the groove bottom is ensured in this way even for irregular surfaces of the groove bottom so that a satisfactory cleaning action can be achieved.

Damage to the all-steel sawtooth arrangement caused by the cleaning process can be reliably prevented when the cleaning portion is secured on a support so as to be movable in a direction counter to the tensioning force produced by the tensioning device. In this manner it is achieved that the cleaning portion can be deflected in a direction counter to the tensioning direction when a high resistance is encountered during the cleaning process, which can be, for example, caused by sawteeth buckled into the grooves of the all-steel sawtooth arrangement, in order to thereby prevent an excessive loading of the all-steel sawtooth arrangement by the cleaning process as well as breaking off of the cleaning portion.

It was found that the last described embodiment of the invention can be realized in a constructively especially simple manner when the cleaning portion is pivotably secured on the support so as to pivot about a pivot axis extending approximately perpendicularly to the tensioning direction. An especially compact design that simultaneously ensures a simple operation can be ensured in this context when the cleaning element comprises a lever supported so as to be pivotable about the pivot axis and extending on both sides of the pivot axis in a direction that extends substantially perpendicularly thereto. The lever is provided on one side of the pivot axis with the cleaning portion and on the other side of the pivot axis with a coupling area for connecting the tensioning device thereto. In this embodiment according to the invention, the tensioning device can be formed in an especially simple way as a spring, preferably in the form of a tension spring, more preferred in the form of a coil spring, secured, on the one hand, on the support and, on the other hand, on the coupling area.

In the case that the cleaning portion meets a resistance in the groove of the all-steel sawtooth arrangement, for example, in the form of a bent sawtooth of the all-steel sawtooth arrangement, and that a deflection movement of the cleaning portion does not occur in the desired way, for example, when the cleaning portion is canted in the groove of the all-steel sawtooth arrangement, it has been proven to be especially expedient for making a continued cleaning process possible when the cleaning device according to the invention has an actuating element with which the cleaning portion can be removed from the groove bottom against the tension of the tensioning device. In this manner it can be achieved that the cleaning process can be continued with manual intervention by means of the actuating element. For this purpose, the actuating element can be configured in a constructively especially simple and very compact manner when it has an eccentric lever that is rotatably secured on the support so as to rotate about a rotational axis extending preferably perpendicularly to the pivot axis and is coupled to the lever of the cleaning element. With such an eccentric lever a disturbance-free removal of the cleaning portion from the bottom of the groove is made possible by a simple rotational movement with which simultaneously a removal force that overcomes even greater clamping forces is transmitted onto the cleaning section by means of the leverage action provided by the eccentric lever.

For cleaning an all-steel sawtooth arrangement of a swift of a carding machine or card formed usually by a sawtooth wire wound in a coil shape onto a circular cylinder mantle surface of a support of the all-steel sawtooth arrangement, it has been proven to be especially expedient when the cleaning portion is forced in the radial direction into the grooves of the all-steel sawtooth arrangement formed between the individual sawtooth wire sections that are defined by the windings of the sawtooth wire and then, during the actual cleaning process, is guided in the axial direction by the all-steel sawtooth arrangement during the course of a rotational movement of the swift, without staggering in the circumferential direction, in order to thus make possible a complete cleaning of the all-steel sawtooth arrangement without requiring the provision of a specific drive element for the cleaning device. For this purpose, the cleaning portion is expediently supported in a slidable manner in a direction transverse to the longitudinal direction of the sawtooth wire section to be cleaned therewith.

This displaceable support of the cleaning portion can be realized constructively in a very simple manner when the cleaning element is secured by a slide which is preferably formed by the support and is slidable along a guide element extending parallel to the displacement direction and formed preferably as an aluminum extruded section.

With such a slide an especially low-friction displacement of the slide, and thus also of the cleaning portion, in the displacement direction can be realized when the slide has at least one guide roller which is supported so as to be rotatable about a roller axis positioned perpendicularly to the displacement direction and can be placed against a guide surface of the guide element, wherein the guide surface is preferably an outer peripheral surface of the guide element.

With the last disclosed all-steel sawtooth arrangement an especially stable and simultaneously low-friction guiding of the slide can be achieved when it has at least two, preferably at least three, more preferred at least four, guide rollers that can be placed respectively against one guide surface of the guide element, wherein the individual guide surfaces are preferably positioned to form an angle of approximately 90° with one another. This means that in an especially preferred embodiment of the invention the guide element has a square or rectangular cross-section in a section plane extending perpendicularly to the displacement direction and that at least one guide roller is resting against each one of the outer surfaces of the guide element that form an angle of 90° with one another.

By using a slide which is resting by means of guide rollers on the guide element, tilting of the slide, and thus also of the cleaning portion, about a tilting axis extending perpendicularly to the displacement direction can be reliably prevented when the slide has at least two guide rollers spaced apart in the displacement direction and preferably placeable against the same guide surface.

A slide of the cleaning device according to the invention, suitable for coupling a plurality of guide rollers that can be placed against guide surfaces forming an angle of 90° with one another, can be realized in a constructively especially simple manner when it comprises an angular profile extending in the displacement direction and having two legs forming an angle of approximately 90° with one another. At least one guide roller, supported to rotate about a roller axis that is perpendicular to the leg, is mounted on each leg.

In an especially advantageous embodiment of the invention, the slide is arranged such that it embraces the guide element at least partially. With this all-steel sawtooth arrangement, the guide element can also be used for guiding further processing tools for reconditioning the all-steel sawtooth arrangement, for example, a grinding element, which are received at least partially in the guide element and during the cleaning operation are surrounded by the slide supporting.the cleaning portion. For guiding these further processing tools, the guide element expediently has a guide groove being covered by the slide. If for the operation of the additional processing tools, as, for example, a grinding head disclosed in DE 196 05 635 C2, an additional drive unit is required, an especially compact configuration can be achieved when the guide element is formed as a hollow profile and the guide groove opens into a hollow space penetrating the guide element in the longitudinal direction or the displacement direction, because in this all-steel sawtooth arrangement important components of the drive device, such as, for example, an additional drive belt coupled to the processing tool, can be housed within the hollow space.

As has been explained already above, the cleaning device according to the invention can be operated such that it is not moved in the circumferential direction of the swift of a carding machine or card and that also in the radial direction of the swift only a movement caused by the tensioning device is performed. For this type of operation of the cleaning device according to the invention it is expedient to provide an advancing device that can be secured relative to a frame of a machine, for example, a carding machine, comprising the all-steel sawtooth arrangement. By means of the advancing device the cleaning portion can be advanced in the direction toward the all-steel sawtooth arrangement. Advancing devices useable in connection with this invention are, for example, described in DE 196 05 635 C2. The disclosure of this document with respect to the advancing devices described therein is therefore incorporated into this description by express reference.

The time for cleaning an all-steel sawtooth arrangement by using the cleaning device according to the invention can be significantly shortened when the cleaning device comprises a plurality of cleaning portions spaced from one another in a direction transverse to the longitudinal direction of the sawtooth wire sections. This embodiment of the invention can be used with special advantage for cleaning all-steel sawtooth arrangements which are obtained by a multi-strand winding, as, for example, described according to DIN ISO 5234.

An increased operational reliability in regard to the use of the cleaning device according to the invention can be obtained when the cleaning portion is not only movable in a direction opposite to the tensioning force of the tensioning device but is additionally produced of an elastically deformable material. Accordingly, pursuant to an especially preferred embodiment of the invention, at least one of the cleaning portions is manufactured of spring steel.

As can be taken from the above description, a method according to the invention for cleaning an all-steel sawtooth arrangement by using the cleaning device according to the invention is characterized primarily in that a cleaning portion of the cleaning device is introduced into a groove of the all-steel sawtooth arrangement formed between neighboring sawtooth wire sections of the all-steel sawtooth arrangement and brought into contact with the groove bottom, wherein subsequently a relative movement between the all-steel sawtooth arrangement and the cleaning portion is initiated in order to so lift foreign particles off the groove bottom and remove them from the all-steel sawtooth arrangement. In this context, the relative movement between the cleaning portion and the all-steel sawtooth arrangement during the cleaning of an all-steel sawtooth arrangement, mounted on the swift of a carding machine or a card in a circumferential coil shape, is realized expediently in that the swift is set in motion rotatingly while the cleaning portion is stationary in the circumferential direction and is guided in the axial direction of the swift by the coil-shaped rotating sawtooth wire.

In the following, the invention will be explained with reference to the drawing to which reference is being had with respect to all details that are important to the invention but not explained in detail in the description.

DESCRIPTION OF THE PREFERRED EMBODIMENTS

Figure 1:
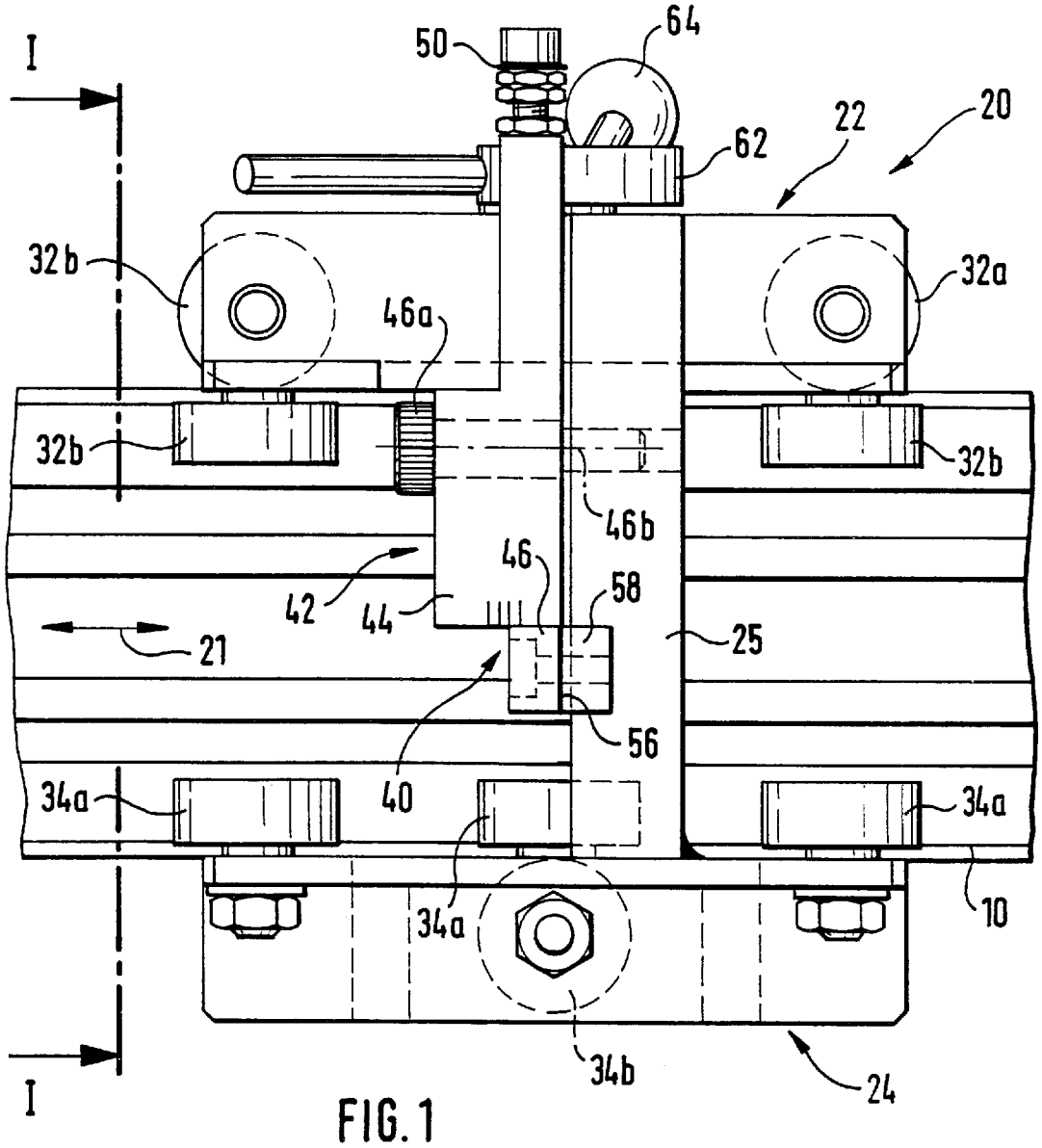
FIG. 1 a plan view onto the cleaning device according to the invention.

The cleaning device illustrated in the drawing is comprised essentially of a guide element in the form of a guide rail 10 made of an aluminum extruded section, a slide 20 displaceable in the directions indicated by double arrow 21 along the guide rail 10, and a cleaning element 40 arranged on the slide 20.

Figure 2:
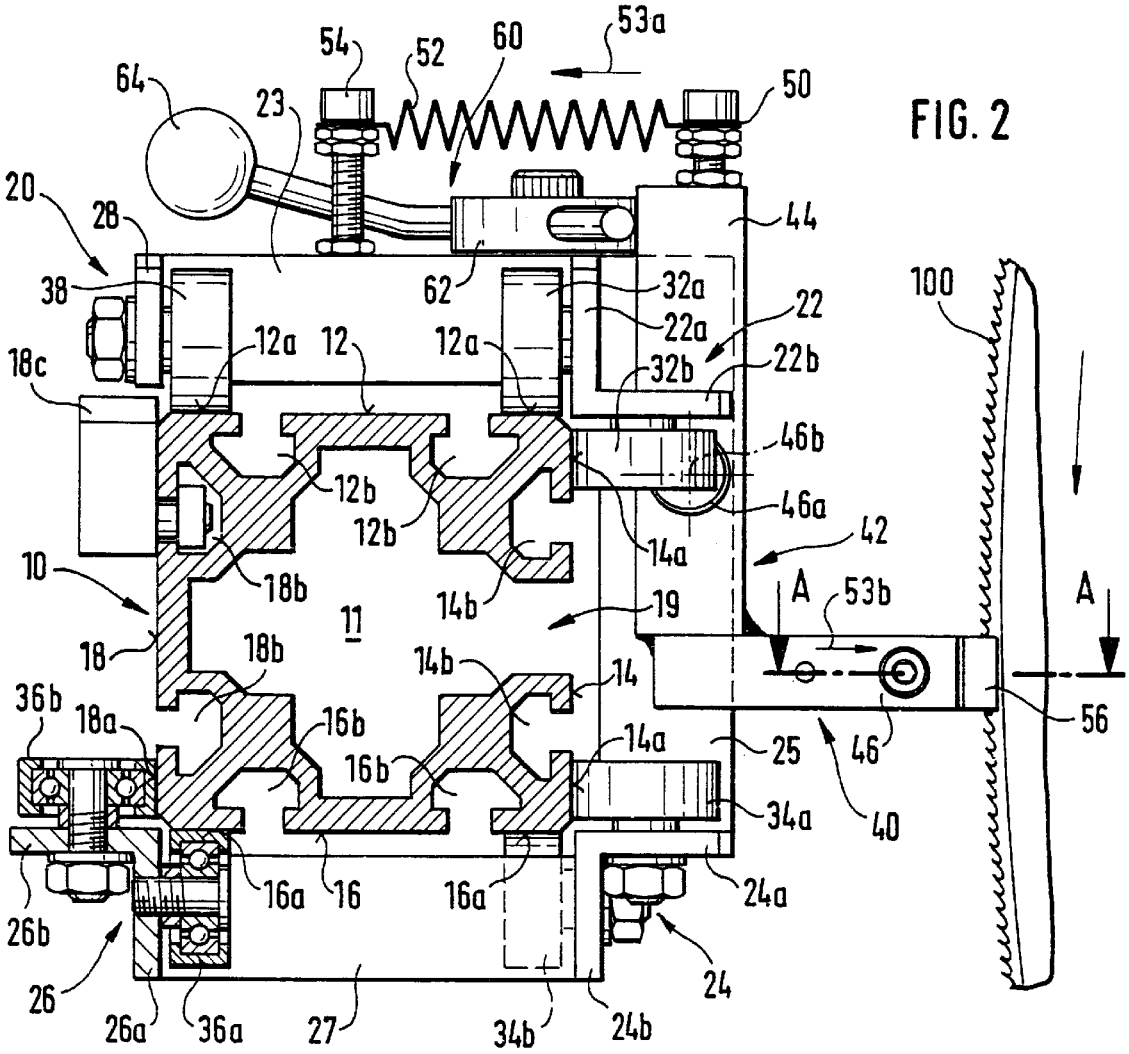
FIG. 2 a sectional view along the section plane I—I indicated in FIG. 1 of the cleaning device illustrated in FIG. 1.

As illustrated especially clearly in FIG. 2, the guide element in the form of a guide rail 10 is formed as a hollow profile of a substantially square cross-section and a hollow space 11 penetrating the guide rail 10 in the longitudinal direction. The outer surfaces 12, 14, 16, and 18 of the hollow profile 10, which form substantially an angle of approximately 90° relative to one another, are provided with grooves 12*b*, 14*b*, 16*b*, and 18*b* in the longitudinal direction of the guide groove 10 which have an approximately T-shaped cross-section. These grooves are provided for securing further guide elements, stop elements or the like on the guide rail, as illustrated, for example, by the stop element 18*c* secured on the outer surface 18 in the groove 18*b*. In addition, these grooves also serve to fasten the guide rail on the machine, such as a carding machine, or a cleaning frame by means of T-shaped sliding blocks and an advancing slide, as will be explained in the following in context with FIG. 4.

Moreover, on the outer surface 14 of the guide rail 10 a guide groove 19 is arranged between the grooves 14*b* with T-shaped cross-section and opens into the hollow space 11 penetrating the guide rail 10. This guide groove 19 serves to guide a grinding head, as disclosed, for example, in DE 196 05 635 C2, of a device for grinding the all-steel sawtooth arrangements, whose drive belts are arranged in the hollow space 11.

The slide 20 of the cleaning device illustrated in FIGS. 1 and 2 embraces the outer surfaces 12, 14 and 16 of the guide rail 10 completely and has moreover a guide roller 36*b* resting against a guide surface 18*a* of the outer surface 18. The slide 20 is comprised essentially of three angle profiles 22, 24 and 26. Each angle profile has two legs 22*a*, 22*b*; 24*a*, 24*b*; and 26*a*, 26*b* which form an angle of approximately 90° with one another. The apex of the angle profile 22 extends along the edge forming a transition between the outer surface 12 and the outer surface 14 of the guide rail 10. Similarly, the apex of the angle profile 24 extends along the edge forming the transition between the outer surface 14 and the outer surface 16 of the guide rail 10, while the apex of the angle profile 26 extends along the edge forming the transition between the outer surface 16 and the outer surface 18. In this context, the legs 22*a*, 22*b*; 24*a*, 24*b*; and 26*a*, 26*b* of the angle profiles 22, 24, and 26 extend respectively approximately parallel to the adjoining outer surfaces 12, 14, 16, and 18 wherein the individual legs form an extension of these outer surfaces.

In addition to the angle profiles 22, 24, and 26, the slide 20 also has a stay 28, which extends along the edge forming the transition between the outer surface 18 and the outer surface 12 and which forms an extension of the outer surface 18, as well as connecting stays 23, 25, and 27 extending approximately perpendicularly to the longitudinal direction of the guide rail between the stay 28 and the angle profile 22, the angle profile 22 and the angle profile 24, respectively, the angle profile 24 and the angle profile 26. At the outer ends of the stay 28 and of the legs 22*a*, 22*b*; 24*a*, 24*b*; and 26*a*, 26*b* of the angle profiles 22, 24, and 26, when viewed in the longitudinal direction of the guide rail 10, guide rollers 38; 32*a*, 32*b*; 34*a*, 34*b*; and 36*a*, 36*b* are mounted which are respectively supported so as to rotate about roller axes extending perpendicularly to the stay 28 and the respective legs 22*a*, 22*b*; 24*a*, 24*b*; and 26*a*, 26*b* of the angle profiles 22, 24, 26.

Each one of the guide rollers 38; 32*a*, 32*b*; 34*a*, 34*b*; and 36*a*, 36*b* rests against a guide surface 12*a*, 14*a*, 16*a*, and 18*a* of the outer surfaces 12, 14, 16, and 18 of the guide rail 10 positioned immediately adjacent to one of the edges of the guide rail 10. In this context, the guide surfaces 12*a*, 14*a*, 16*a*, and 18*a* are positioned respectively between the grooves 12*b*, 14*b*, 16*b*, and 18*b* arranged in the corresponding outer surfaces 12, 14, 16, and 18 and the edges forming the transition between the individual outer surfaces. This provides a safe guiding of the slide 20 along the guide rail 10 even when further guide elements or the like are arranged in the grooves 12*b*, 14*b*, 16*b*, and 18*b*. Moreover, by arranging at least two guide rollers on each leg of the angle profiles 22, 24, 26 and the stay 28, respectively, which guide rollers are arranged staggered relative to one another in the longitudinal direction of the guide rail 10 (see FIG. 1), it is achieved that the slide 20 overall is secured against tilting about a tilting axis which is perpendicular to the guide rail 10. As can be seen when viewing FIGS. 1 and 2 together, two further guide rollers 36*a*, 36*b* are additionally mounted on the legs 26*a* and 26*b* between the outer guide rollers in order to thus provide a further securing of the guiding action of the slide 20.

The cleaning element 40 is comprised essentially of an L-shaped lever 42 and a cleaning blade 56. The longer leg 44 of the L-shaped lever 42 extends approximately parallel to the outer surface 14 and perpendicularly to the longitudinal direction of the guide rail 10. The shorter leg 46 is stationarily mounted approximately in the area of the center of the outer surface 14 on the longer leg 44 of the lever 42 and extends approximately perpendicularly thereto and perpendicularly to the longitudinal axis of the guide rail 10 away from the guide rail 10 in the direction of the all-steel sawtooth arrangement 100, only schematically illustrated in FIG. 2, of the swift of a card. For this purpose, the guide rail 10 is fastened by means of an advancing device, not represented in the drawing, on a frame of the card so that it extends approximately parallel to the cylinder axis of the swift.

The cleaning blade 56 is mounted on the end of the shorter leg 46 remote from the longer leg 44 of the lever 42 so that it extends substantially in the longitudinal direction of the sawtooth wire forming the all-steel sawtooth arrangement support in a coil shape. The dimensions of the cleaning blade 56 are selected such that it can be immersed into the grooves of the all-steel sawtooth arrangement, formed between the individual windings of the all-steel sawtooth arrangement, down to the groove bottom. As can be seen especially clearly in FIG. 3, the cleaning blade 56 is fastened to the lever 42 by a clamping screw 54, penetrating the shorter leg 46 of the lever 42, and by a clamping piece 58.

When viewing the FIGS. 1 and 2 together, it is clear that the longer leg 44 of the L-shaped lever 42 is articulated on the slide 20 by a pivot bolt 46*a* that penetrates it and is received in the connecting stay 25 between the angle profile 22 and the angle profile 24. Accordingly, it is realized that the lever 42 overall is pivotably connected to the slide 20 so as to be pivotable about the pivot axis 46*b* that extends parallel to the longitudinal axis of the guide rail 10. The end of the longer leg 44 of the lever 42 facing away from the shorter leg 46 is provided with a coupling area 50 formed by a screw bolt for a tension spring 52 extending approximately perpendicularly to the longitudinal axis of the guide rail 10 and perpendicularly to the longer leg 44 of the lever 42. The other end of the tension spring 52 is fastened by means of a screw bolt 54 stationarily on the connecting stay 23 between the stay 28 and the angle profile 22. By means of the tension spring 53 the upper end of the leg 44 of the lever 42 is forced in the direction toward the screw bolt 54, as indicated by the arrow 53*a*. At the same time, the cleaning blade 56 is forced by the tension spring 52 in the direction toward the all-steel sawtooth arrangement 100 as is indicated by the arrow 53*b*. In the case that within the groove of the all-steel sawtooth arrangement 100 to be cleaned an excessively high resistance occurs, the cleaning blade 56 will lift automatically off the groove bottom against the tensioning force of the tension spring 52.

In the case that the automatic lifting of the cleaning blade 56 away from the groove bottom of the all-steel sawtooth arrangement is hindered by an excessive clamping force, the cleaning blade 56 can also be removed from the all-steel sawtooth arrangement 100 by an eccentric lever 60. This eccentric lever comprise an eccentric disc 62, that is supported so as to be eccentrically rotatable perpendicularly tot he pivot axis 46*b* and perpendicularly to the longitudinal axis of the guide rail 10, and a grip 64 secured on the eccentric disc 62. The eccentric disc 62 rests against the upper end of the longer leg 44 of the lever 42. Accordingly, the upper end of the longer leg 44 of the lever 42 can be moved by rotation of the eccentric disc 62 in the direction indicated by arrow 53*a* counter to the tension direction of the tension spring 52 so that the cleaning blade 56 can be lifted off the groove bottom of the all-steel sawtooth arrangement. In addition, the eccentric lever 60 is also to be used for starting a cleaning process employing the cleaning device illustrated in FIGS. 1 through 3, as will be explained in the following with the aid of FIGS. 4*a* and 4*b*.

Figure 3:
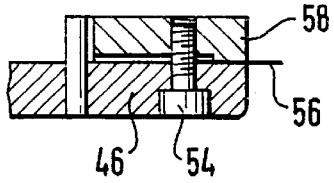
FIG. 3 a sectional view along the section plane III—III indicated in FIG. 2 of the cleaning portion of the cleaning device illustrated in FIGS. 1 and 2.
Figure 4A:
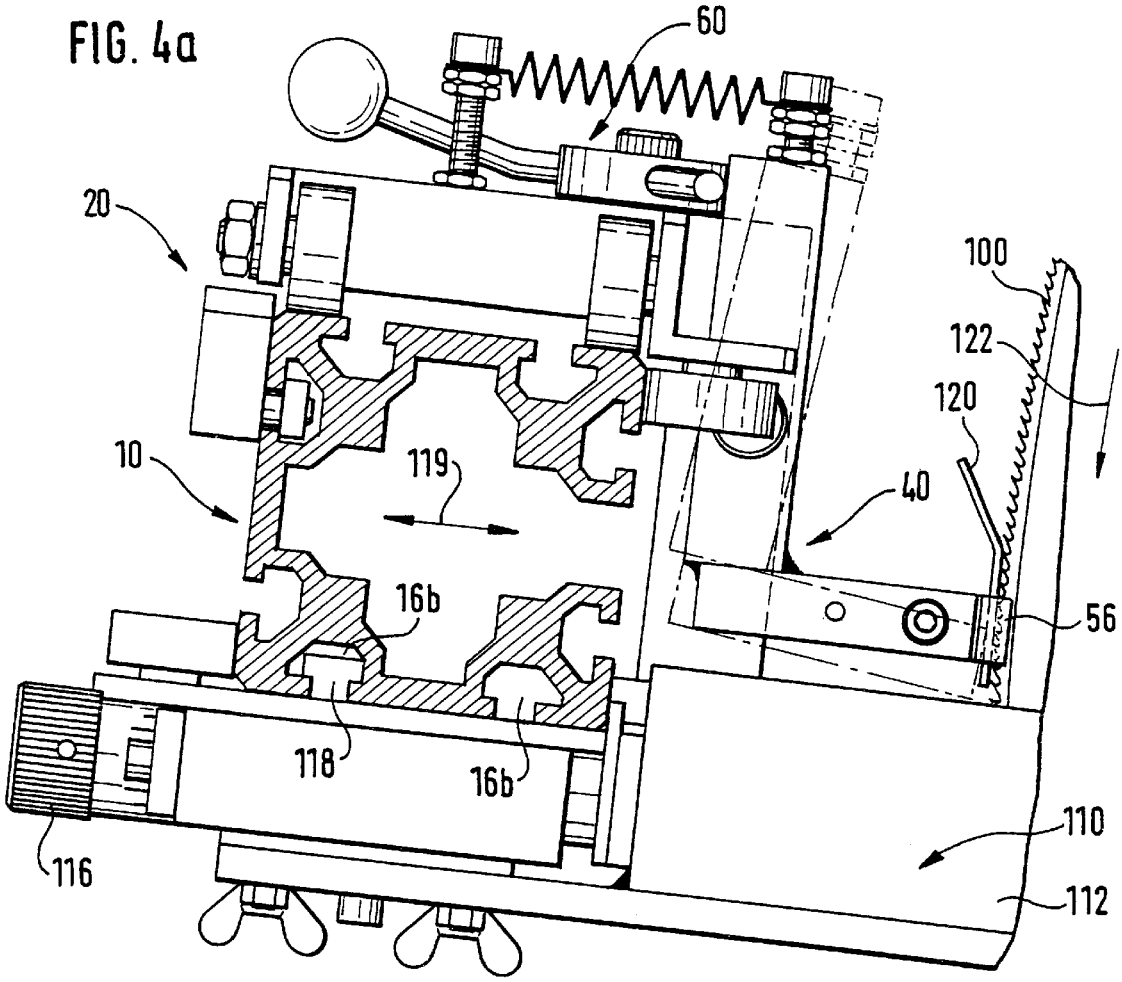
FIGS. 4*a* and 4*b* a representation for illustrating the attachment and arrangement of the cleaning device illustrated in FIGS. 1 through 3 in the area of the swift of a carding machine.
Figure 4B:
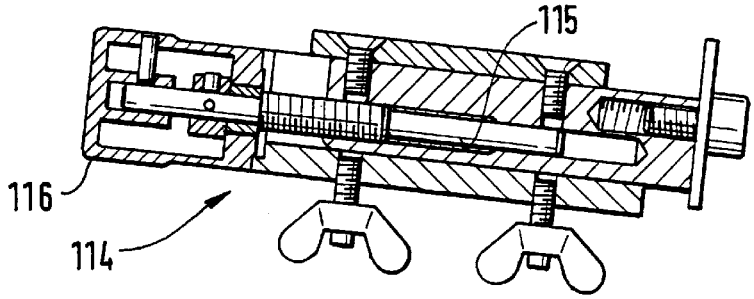

According to FIGS. 4*a* and 4*b*, for performing the cleaning process, the cleaning device illustrated in FIGS. 1 through 3 is fastened on the machine frame, for example, the frame of a carding machine or a special cleaning frame, by means of two fastening devices 110 mounted on the axial ends of the guide rail 10. In this context, each of the fastening devices 110 comprises a holder 112 fixedly connected on the machine or cleaning frame as well as a guide slide 114. The guide slide 114 comprises at least one T-shaped sliding block 118 which is received in one of the grooves 16*b* in the guide rail 10. Moreover, a threaded bore 115 (see FIG. 4*b*) is provided in the guide slide 114 which is engaged by an adjusting screw 116 rotatably supported on the holder 112. With the aid of the combination of the guide slide 114 and adjusting screw 115 received therein, the guide rail 10 can be aligned precisely parallel to the cylinder axis of the swift arrangement 100 by a corresponding actuation of the adjusting screw 116 of the fastening devices 110 fastened to the two axial ends of the guide rail 10 since the two axial ends of the guide rail 10 can be moved back and forth in the radial direction by actuation of the adjusting screws 116, as is illustrated by the double arrow 119 in FIG. 4*a*.

During this adjusting process, the cleaning portion 56 of the cleaning element 40 is retracted by actuation of the eccentric lever 60, as illustrated in a dashed line in FIG. 4*a*. After adjustment of the guide rail 10, the slide 20 is moved to one of the axial ends of the all-steel sawtooth arrangement 100. Subsequently, the guide rail 10, and thus also the cleaning portion 56, is advanced by actuation of the adjusting screws 116 of the fastening devices 110 until the tip of the cleaning portion 56 is positioned one to two millimeters above the tips of the all-steel sawtooth arrangement 100. For monitoring the correct position of the cleaning portion 56 relative to the all-steel sawtooth arrangement 100, a sensing gauge 120 (see FIG. 4*a*) can be guided between the all-steel sawtooth arrangement 100 and the cleaning portion 56. The other side of the guide rail 10 is correspondingly advanced by moving the slide 20 to the other axial end of the guide rail 10 and by repeating the above described advancing process. For starting the cleaning process, the eccentric lever 60 is rotated such that the cleaning portion 56 is immersed into the grooves of the all-steel sawtooth arrangement. Subsequently, the all-steel sawtooth arrangement 100 is then started in rotation, as illustrated in FIG. 4*a* by the arrow 122.

During the cleaning process of the all-steel sawtooth arrangement 100, formed by a coil-shaped circumferentially extending sawtooth wire mounted on the arrangement support, the cleaning blade 56 is automatically entrained by the all-steel sawtooth arrangement in a direction parallel to the coil axis. This is achieved in the device according to FIGS. 1 through 3 with especially low friction by the guide rollers 38; 32*a*, 32*b*; 34*a*, 34*b*; 36*a* and 36*b* resting against the guide surfaces 12*a*, 14*a*, 16*a*, and 18*a*, wherein a further friction reduction can be achieved by a ball bearing support of the guide rollers on the respective legs of the angle profiles or the stay 28, as represented in an exemplary fashion in FIG. 2 for the guide rollers 36*a* and 36*b*.

By designing the slide 20 as an arrangement embracing the guide rail 10 it can be moreover achieved that the cleaning device illustrated in the drawing can be operated by using the same guide rail that is used in the after grinding of the all-steel sawtooth arrangement by means of the grinding device described in DE 196 05 635 C2. For this purpose, the grinding head of the device described in the document must only be removed from the slide of the grinding device while the entire drive unit of the known grinding device, including the slide that otherwise supports the grinding head, remains within the hollow space 11 of the guide rail, respectively, the groove 19 opening into the hollow space 11.

The invention is not limited to the embodiment explained with the aid of the drawing. In addition, the use of cleaning devices with a plurality of cleaning blades is envisioned wherein each one engages a groove of the all-steel sawtooth arrangement formed between two adjacently positioned threads or windings of a sawtooth wire. Moreover, the slide 20, for simplifying its construction, can also be provided with simple guide elements which rest glidingly against the guide surfaces of the guide rail. In addition, it is also possible to employ a guide rail with rectangular, circular, or polygonal cross-section. Also, an embodiment is envisioned in which the cleaning blade is forced into the grooves of the all-steel sawtooth arrangement by a pressure spring extending parallel to the shorter leg 46 of the lever 42.

What is claimed is:

1. A cleaning device for cleaning an all-steel sawtooth arrangement comprising adjacently arranged sawtooth wire sections, wherein between two adjacent ones of the sawtooth wire sections a groove of the all-steel sawtooth arrangement is formed, respectively, wherein the groove extends from the tooth tips of the sawtooth wire sections to a groove bottom, the cleaning device comprising one or more cleaning elements for removing foreign particles from the groove, wherein the cleaning element comprises a cleaning portion configured to be placed against the groove bottom of the groove, further comprising a tensioning device, wherein the cleaning element is coupled to the tensioning device and wherein the tensioning device is configured to force the cleaning portion by a tensioning force in a direction toward the groove bottom, and a support, wherein the cleaning element is supported on the support and is configured to move in a direction counter to the tensioning force of the tensioning device.

2. The cleaning device according to claim 1, wherein the cleaning portion is a cleaning blade.

3. The cleaning device according to claim 1, wherein the cleaning element is configured to pivot about a pivot axis extending perpendicular to the tensioning device.

4. The cleaning device according to claim 3, wherein the cleaning element comprises a lever configured to be pivotably supported on the support so as to pivot about the pivot axis, wherein the lever has a first portion and a second portion extending away from the pivot axis in a direction approximately perpendicular to the pivot axis, wherein the cleaning portion is arranged on the first portion of the lever and wherein the second portion of the lever has a coupling area configured to couple the tensioning device to the second portion of the lever.

5. A cleaning device according to claim 4, wherein the tensioning device comprises a spring having a first end connected to the support and having a second end connected to the coupling area of the second portion of the lever.

6. The cleaning device according to claim 5, wherein the spring is a coil spring.

7. The cleaning device according to claim 5, wherein the spring is a tension spring.

8. The cleaning device according to claim 4, comprising an actuating element configured to remove the cleaning portion from the groove bottom against the tensioning force of the tensioning device.

9. The cleaning device according to claim 8, wherein the actuating element comprises an eccentric lever rotatably supported on the support and coupled to the lever of the cleaning element, wherein the actuating element is configured to pivot about a rotational axis extending approximately perpendicularly to the pivot axis of the cleaning element.

10. The cleaning device according to claim 1, wherein the cleaning portion is configured to move in a displacement direction extending transverse to a longitudinal direction of the all-steel sawtooth arrangement.

11. The cleaning device according to claim 10, comprising a guide element extending parallel to the displacement direction and having guide surfaces, wherein the support is a slide configured to move along the guide element.

12. The cleaning device according to claim 11, wherein the guide element is an aluminum extruded section.

13. The cleaning device according to claim 11, wherein the slide has one or more guide rollers supported on the slide and configured to be rotatable about a roller axis extending perpendicularly to the displacement direction and to be placed against one of the guide surfaces of the guide element.

14. The cleaning device according to claim 13, wherein the guide surfaces form an outer peripheral surface of the guide element and wherein two adjacent ones of the guide surfaces form an angle of approximately 90° relative to one another, respectively.

15. The cleaning device according to claim 13, wherein at least two of the guide rollers are provided and wherein each one of the guide rollers rests against a different one of the guide surfaces of the guide element.

16. The cleaning device according to claim 13, wherein at least three of the guide rollers are provided and wherein each one of the guide rollers rests against a different one of the guide surfaces of the guide element.

17. The cleaning device according to claim 13, wherein at least four of the guide rollers are provided and wherein each one of the guide rollers rests against a different one of the guide surfaces of the guide element.

18. The cleaning device according to claim 13, wherein at least two of the guide rollers are positioned on the same one of the guide surfaces and are spaced apart from one another in the displacement direction.

19. The cleaning device according to claim 13, wherein the slide comprises at least one angle profile, extending in the displacement direction and comprising two legs forming an angle of approximately 90° with one another, wherein at least one of the guide rollers is supported on each one of the legs and wherein the roller axes extend perpendicularly to the legs.

20. The cleaning device according to claim 11, wherein the slide at least partially embraces the guide element.

21. The cleaning device according to claim 11, wherein the guide element has a guide groove and wherein the slide is configured to cover the guide groove.

22. The cleaning device according to claim 21, wherein the guide element is a hollow profile having a hollow space penetrating the guide element in the longitudinal direction and wherein the guide groove opens into the hollow space.

23. The cleaning device according to claim 1, comprising an advancing device configured to advance the cleaning portion in a direction toward the all-steel sawtooth arrangement, wherein the advancing device is configured to be secured relative to a frame of the machine comprising the all-steel sawtooth arrangement.

24. The cleaning device according to claim 1, wherein several of the cleaning portions are provided and are spaced apart from one another in a direction transverse to the longitudinal direction of the all-steel sawtooth arrangement.

25. The cleaning device according to claim 1, wherein at least one of the cleaning portions is formed of spring steel.

* * * * *